United States Patent [19]

Brendlinger et al.

[11] Patent Number: 4,507,190

[45] Date of Patent: Mar. 26, 1985

[54] HORIZONTAL-PASS ELECTROTREATING CELL

[75] Inventors: Edward C. Brendlinger, Pitcairn; Richard F. Higgs, Monroeville; Issa J. Kharouf, Pittsburgh, all of Pa.

[73] Assignee: United States Steel Corporation, Pittsburgh, Pa.

[21] Appl. No.: 521,476

[22] Filed: Aug. 8, 1983

Related U.S. Application Data

[63] Continuation-in-part of Ser. No. 425,762, Sep. 28, 1982.

[51] Int. Cl.[3] ..... C25D 17/00; C25D 17/10

[52] U.S. Cl. ..... 204/206

[58] Field of Search ..... 204/206–211

[56] References Cited

U.S. PATENT DOCUMENTS

| | | | |
|---|---|---|---|
| 2,317,242 | 4/1943 | Allen | 204/206 |
| 2,673,836 | 3/1954 | Vonada | 204/28 |
| 3,471,375 | 10/1969 | Cooke | 204/206 |
| 3,616,426 | 10/1971 | Nakao | 204/207 |
| 4,118,302 | 10/1978 | Gobert | 204/206 |
| 4,132,609 | 1/1979 | Bush | 204/206 |

*Primary Examiner*—T. M. Tufariello

*Attorney, Agent, or Firm*—Arthur J. Greif

[57] ABSTRACT

The invention is directed to an electrotreating apparatus, utilizing horizontal-pass electrotreating cells wherein the strip passes through the corridors of one or more of such cells. Electrolyte is caused to flow through the corridor(s) and overflow into a collector tank for recycle through the system. Electrode replacement is facilitated by inserting the electrodes through the outer walls of each corridor. Proper sealing of such electrodes is achieved by utilizing an electrode with a T-shape cross-section, in which the top of the T is a flange for exerting a bearing, liquid-tight sealing force against the outer surface of the corridor wall, while the vertical portion of the T comprises that part of the electrode which is inserted into a hole in the corridor wall.

6 Claims, 4 Drawing Figures

Figure 4:
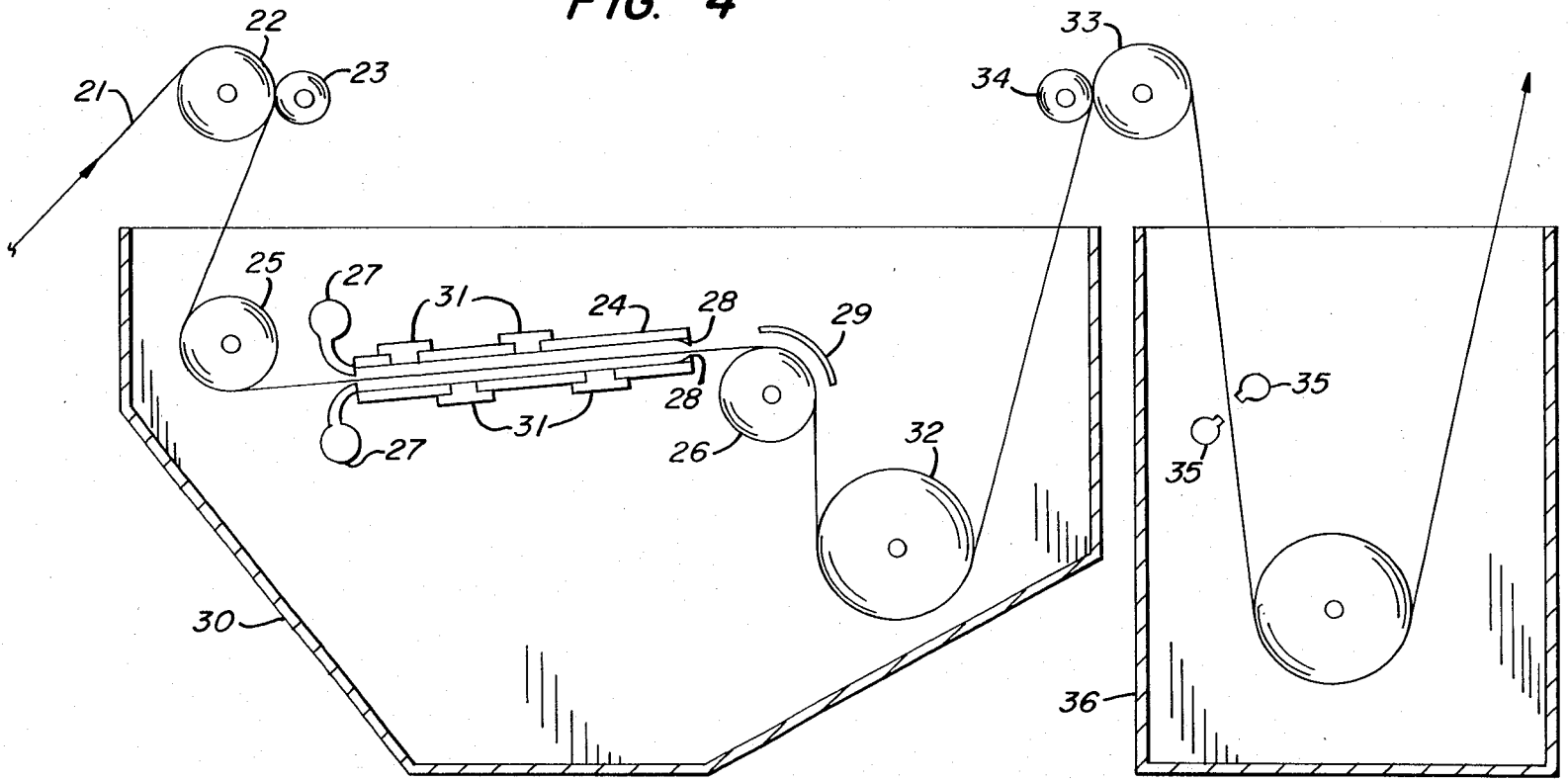

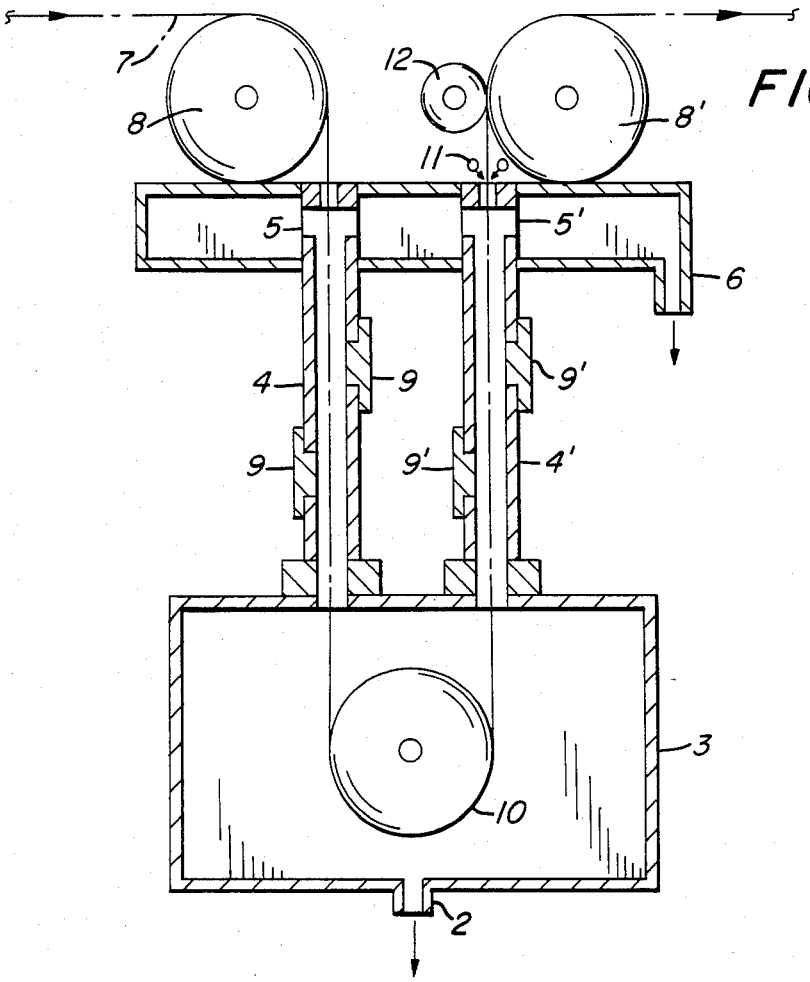
FIG. 1
FIG. 2
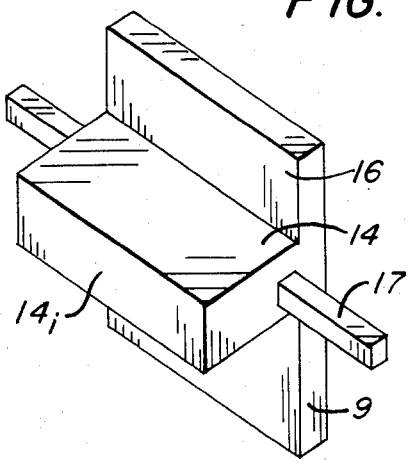
FIG. 3
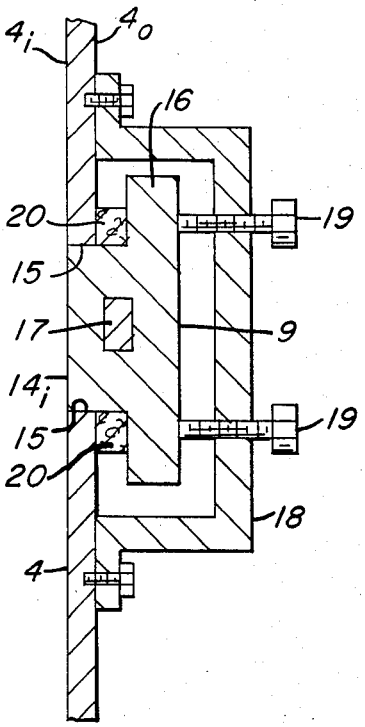

HORIZONTAL-PASS ELECTROTREATING CELL

This application is a continuation-in-part of our earlier application Ser. No. 425,762, filed Sept. 28, 1982.

In the electrotreating (e.g. plating, cleaning, pickling) of metal strip, the most widely used system employs what may be termed a "conventional" vertical pass method in which the metal strip enters a tank by passing over a roll, is fed downward through the bottom of the tank where another roll is located, is then wrapped around this bottom roll or sink roll, and fed vertically upward until it exits from the tank over a roll in the same manner as it entered. The geometry employed in such conventional vertical systems is such that a relatively great distance between the strip and the electrodes is required, thus necessitating high voltages for relatively small current densities. This, in turn, requires either extremely expensive direct current power supplies or a reduction in the amount of current utilized, consequently limiting the speed and productivity of the electrotreating process. In addition to the spacing employed, the maximum currents which can be applied are also limited by the relatively small amount of turbulence in the electrolyte, resulting in the inhibition (concentration polarization) of the rate at which the electrotreating process can be effected. To overcome these limitations of the conventional vertical cell, the art has resorted to what may be termed horizontal plating cells, see for example U.S. Pat. Nos. 3,471,375, 3,616,426 and 3,718,547, wherein the strip is passed horizontally between a pair of closely spaced electrodes housed in the tube-like conduit through which electrolyte is pumped at a high turbulence to overcome concentration polarization limitations. Such horizontal systems have overcome the above-mentioned difficulties inherent in the conventional vertical systems. Nevertheless, since such horizontal systems require a rather radical departure from the conventional vertical tanks, and require significant capital expenditures in removing the vertical tanks and installing completely new apparatus, most facilities still employ such conventional vertical pass systems. As shown in Ser. No. 425,762, the efficiency and high production rates of the horizontal pass systems can also be achieved in a vertical pass system, somewhat analogous to that shown in U.S. Pat. Nos. 2,317,242 and 2,673,836, by a modification of the apparatus shown therein to enable the use of insoluble electrodes which (i) may be accurately and closely spaced from the strip surface (e.g. about $\frac{1}{4}$ to $1\frac{1}{2}$ inches) to increase the efficiency of the electrotreating process and (ii) may readily be removed, reconditioned and reinserted, so as to maintain such requisite close spacing. These attributes of the new electrodes make them applicable to horizontal-type plating cells, as well.

The advantages of the instant invention will become more apparent from a reading of the following description when read in conjunction with the appended claims and the drawings in which:

FIG. 1 is a cross-section of the vertical electrotreating cell of this invention, showing the basic elements thereof, FIG. 2 is an enlarged perspective drawing of the T-shaped anodes shown in FIG. 1, FIG. 3 is a cross-sectional illustration of the electrodes shown in FIG. 2, showing one means by which such electrodes may be mounted and sealably inserted into the cell wall, and FIG. 4 is a diagrammatical view of a horizontal-type electrotreating cell, showing the basic elements thereof.

As noted above, a basic deficiency of the conventional-type vertical pass electrotreating apparatus is the inability of such systems to support high current densities. This inability is the result of comparatively (i) poor electrolyte turbulence, resulting in concentration polarization—in which the regions adjacent the electrode and strip surfaces become depleted of the ions requisite for achieving the desired electrotreatment, and (ii) large spacings employed between the electrodes and the strip (necessitated by variations in the pass line of the strip, thus resulting in difficulties in controlling electrode to strip distances), thereby substantially increasing resistance of the electric path and decreasing the efficiency of process. It is well known that the limiting diffusion current density of an electrotreating reaction may be increased by increases in the temperature, concentration and solution velocity of the electrolyte. Since for any specific electrotreating process the concentration and temperature ranges are generally fixed, the most practical method for overcoming concentration polarization is by increasing solution velocity, i.e. turbulence of the electrolyte. One means for achieving such high velocities, in a vertical pass system, is by forcing the electrolyte through a restricted corridor such as shown in U.S. Pat. Nos. 2,317,242 and 2,673,836. It was found, however, while the problem of concentration polarization could be overcome by a flow system analogous to that shown in the aforementioned patents, that the means for mounting electrodes shown therein were inappropriate for achieving the close electrode-to-strip spacings requisite in processes designed for the application of high current densities. In accord with the instant invention, such vertical-pass apparatus has therefore been modified to permit the insertion of electrodes from outside the walls of the corridors through which the electrolyte passes, requiring an electrolyte overflow system which prevents contact of the electrolyte with the outside of such walls.

Referring to FIG. 1, the basic elements of the new system, analogous to the aforementioned vertical pass systems, comprise a piping system 2, which through piping from a reservoir (not shown), circulates the electrolyte in the direction of the arrows into the tank 3, up through the tube-like electrotreating corridors 4 and 4', through overflows 5 and 5', and into collector tank 6 for return to the reservoir—thereby maintaining requisite agitation and concentration of the electrolyte solution. Strip 7 enters the cell by initially being wrapped around conductor roll 8 and thereafter passing into the flow channel of corridor 4, the walls of which can be made of metal, plastic-type materials, or any other material compatible with the electrolyte being employed. On each side of the walls of the corridor is an opening wherein one or more T-shaped electrodes 9 are placed, preferably in staggered relationship to those on the opposite wall. Such staggering is particularly desirable for electrodeposition processes so as to prevent one anode from becoming more negative relative to that directly opposite, thus causing electrodeposition to occur on the lower potential anode. After entering tank 3, it is necessary to change the direction of the strip for passage through the next corridor. This is accomplished by sink roll 10. After its upward passage through corridor 4', any contaminants which might be dragged by the strip onto the conductor roll 8' are removed by spray headers 11. To prevent arcing from damaging the strip, hold-down roll 12 may be placed slightly below the tangent point at where the strip contacts the conductor roll.

It is well known that various alternatives are available for conducting electricity into and away from the strip. For example, if the apparatus were to be utilized solely for electrolytic cleaning or pickling, electrodes in the down-pass (or the up-pass) could be made either positive or negative with respect to the steel strip, depending on the polarity of the conductor roll which imparts the same polarity to the strip. Strip polarity can also be varied in either flow channel by varying the lead connections from the power supply. In an electroplating mode, the conductor roll and strip would be made cathodic (negative polarity) with respect to the electrodes, functioning as anodes. While the use of conductor rolls for making direct electrical contact with the strip is preferable for high current density electrotreating processes, i.e. current densities in excess of 500 amps/ft.$^2$, it should be recognized that the use of conductor rolls are not essential and that current transfer to the strip can be effected by what has been termed bipolar electrolyzing (see for example U.S. Pat. No. 2,165,326) in which transfer may be effected from an electrode of one polarity, through the electrolyte to the strip and again through the electrolyte to an electrode of opposite polarity.

Details of a preferred design for the T-shaped electrodes (9 and 9') utilized in the instant apparatus are shown in FIGS. 2 and 3. Electrode 9 comprises two main portions: (i) inner portion 14 for insertion in liquid-tight engagement with the surfaces 15 of the hole in the wall of conduit 4, and (ii) an outer, flange portion 16 for exerting a sealing force against the outer wall surface $4_o$ of the conduit wall. For more efficient current carrying ability, a bus bar 17, e.g. made from copper, may be integrally cast in the electrode body to enable electrical contact to be made from outside of the tank and away from possible contamination by the electrolyte. Additionally, such integral casting provides both better mechanical and electrical contact than would be achieved by the conventional manner of merely bolting the bus bar to the electrode. To prevent perturbation in the flow of the electrolyte through the flow channel of corridor 4, inner electrode face $14_i$ desirably will be designed so as to fit flush with inner wall face $4_i$. To achieve desired liquid-tight sealing, bracket 18 may be employed in conjunction with anchoring screws 19 so that flange portion 16 may be exerted to bear either (a) directly against outer wall $4_0$ (not shown) or (b) against packing 20, both to seal and insulate the flange portion from cell wall. In addition to the improved sealing, and the ease of electricl connection permitted by use of the flange portion 16, the larger, external surface also permits enhanced electrode cooling; e.g. by natural convection, with or without the use of cooling fins, or by conductive cooling with a fluid heat transfer medium.

The electrodes of this invention were also effectively utilized in a substantially horizontal-type electrotreating cell, in a system specifically designed for the plating of TFS-type coatings, described in ASTM 657-74. Although it will generally not be necessary for such a cell to deviate to a significant extent from the horizontal, it should be understood that the teachings of this invention are applicable to tilted cells. Thus, such "substantially horizontal" cells can deviate from the horizontal by as much as ±30°. The plating and rinsing sections of such a system are shown in FIG. 4. Strip 21 is directed to the system, wrapped between conductor roll 22 and hold-down roll 23. Proper pass-line orientation of the strip into and out of the flow channel of corridor 24 is achieved by pass-line deflector rolls 25 and 26. Electrolyte is directed at high velocity through corridor 24, by means of headers 27. After passing lips 28, the exiting electrolyte strikes deflector 29 and is thereby directed to the bottom of the tank 30 which serves as a reservoir for the electrolyte fed to the headers by piping (not shown). Anodes 31 are placed on each side of the walls of the corridor in substantially the same manner shown in FIGS. 2 and 3. Since this apparatus was specifically designed for plating, the anodes are staggered to prevent plating onto the anode with the lower potential. Direction of strip travel may be changed, in well known manner, by sink roll 32, after which the strip exits tanks 30 by wrapping it between conductor roll 33 and hold-down roll 34. Thereafter, rinsing of the plated strip is accomplished, either by spray headers 35 or simply by immersion in rinse solution maintained in rinse tank 36, or by a combination of both. If immersion is the only rinse utilized, a series of such rinse tanks will normally be employed to achieve adequate rinsing of both faces of the strip.

Although the benefits of the instant electrode system are applicable to horizontal-type electrotreating cells utilizing various electrolyte flow patterns, e.g. in which electrolyte is flowed counter-current to or perpendicular to strip travel, the co-current electrolyte flow shown in FIG. 4 is preferred to permit adequate flushing of gases formed during plating—thereby reducing solution resistivity and consequently the power required for such plating. A further preferred feature of the apparatus shown in FIG. 4 is the use of lips 28 near the exit end of the corridor, which lips project from the inner surface of the corridor walls into the flow channel. Although such lips are constructed so as not to contact the strip (spacing between the lip extremities will generally vary from $\frac{3}{8}''$ to $\frac{3}{4}''$, preferably $\frac{3}{8}''$ to $\frac{1}{4}''$ for corridors having a $\frac{7}{8}''$ to 3/2" flow channel), it was found that they nevertheless promote, possibly as a result of hydrodynamic pressure, noticeable stabilization of the strip pass line. Such stabilization is even further improved if the inner surface of the lip, i.e. that surface facing the electrolyte, is concave, as shown.

I claim:

1. In an apparatus for the electrotreating of an extended length of metal strip comprising, a tube-like electrolyte corridor for the passage of electrolyte therethrough, said tube-like corridor being supported with its axis substantially horizontal, means for directing the strip into the inlet of said corridor, means for directing the strip from the outlet of said corridor, means for supplying an electrotreating current to said strip, means for flowing electrolyte into and out of said corridor and means for carrying the electrolyte exiting from said corridor to an electrolyte tank, the improvement, in which said means for supplying an electrotreating current include electrodes inserted into holes in the corridor walls and insertable from the outer surface of said walls, the outer wall surface in proximity to such electrodes being free from contact by the electrolyte, said electrodes (i) having an outer flange portion for exerting a liquid-tight sealing force against the corridor wall outer surface and (ii) an inner portion inserted into said wall holes, such that when so inserted (a) the inner electrode face will be in parallel opposition to a strip face and substantially flush with the corridor wall inner surface and (b) the vertical electrode surface immediate to said inner electrode face is in liquid-tight engagement with the hole surface surrounding it.

2. The method of claim 1, wherein the normal distance between the corridor wall inner surfaces is within the range $\frac{1}{2}$ to 3 inches.

3. The apparatus of claim 2, in which said electrode outer flange portion and inner portion are cast as an integral unit, said outer flange portion being cast around a bus-bar for contact to a terminal of a power source.

4. The apparatus of claim 3, in which said electrolyte inlet is proximate to said strip inlet and said electrolyte outlet is proximate to said strip outlet, whereby the electrolyte is caused to flow co-current with the strip.

5. The apparatus of claim 4, in which said corridor, proximate the electrolyte outlet end thereof, is provided with upper and lower lips, each of which project from the respective corridor wall inner surfaces toward the opposing faces of the strip, but in which the extremities of such projections are spaced apart so as to avoid contact with the strip.

6. The apparatus of claim 5, in which the spacing between said lip extremities is $\frac{3}{8}''$ to $\frac{3}{4}''$, and the inner surfaces of said lips are concave with respect to the electrolyte flow.

* * * * *